United States Patent [19]

Senoski

[11] 3,942,441

[45] Mar. 9, 1976

[54] MODEL ROCKET-GLIDER

[76] Inventor: Walter E. Senoski, 1720 Elderslee Road, Pittsburgh, Pa. 15227

[22] Filed: May 13, 1974

[21] Appl. No.: 469,438

[52] U.S. Cl. ..... 102/34.1; 46/74 A; 102/34.4

[51] Int. Cl.[2] ..... F42B 4/08; F42B 4/10

[58] Field of Search ..... 102/34.1, 34.4, 34; 46/74 C, 79, 81, 86 C, 74 A

[56] References Cited

UNITED STATES PATENTS

| | | | |
|---|---|---|---|
| 3,068,792 | 12/1962 | Brown et al. | 102/34.1 |
| 3,157,960 | 11/1964 | Schutz et al. | 102/34.1 |
| 3,719,145 | 3/1973 | Brown et al. | 102/34.4 |
| 3,787,013 | 1/1974 | McKenzie, Sr. | 102/34.1 |

*Primary Examiner*—Verlin R. Pendegrass
*Assistant Examiner*—C. T. Jordan
*Attorney, Agent, or Firm*—Parmelee, Miller, Welsh & Kratz

[57] ABSTRACT

A model rocket, the nose cone of which is ejected clear of the rocket body after the rocket has spent its fuel, including means for replacing the ejected nose cone during flight with another nose cone and means for altering the configuration wing elevator during flight thereby converting the rocket to a glider.

10 Claims, 5 Drawing Figures

MODEL ROCKET-GLIDER

BACKGROUND OF THE INVENTION

The advent of the space age has engendered a great deal of interest in model rocketry. Model rockets, powered by solid fuel propellant can easily reach heights of several hundreds of feet. As most model rockets are designed for repeated use, recovery means are generally provided to insure a soft landing after the rocket has spent its fuel and attained its maximum altitude, said recovery means usually consisting of a streamer or a parachute. A more sophisticated recovery means comprising a foldable rotor assembly is disclosed in my copending U.S. patent application Ser. No. 378,595, filed July 12, 1973.

As an alternative to said recovery means, it would be desirable to provide a rocket capable of gliding back to earth after it had attained its maximum altitude. However, this cannot be effected simply by enlarging the rocket's fins so as to increase the airfoil surface as might be expected, as model rockets are balanced for only vertical flight, and to achieve a glider effect it is necessary to provide means of altering the balance of the assembly as well as the airfoil configuration during flight in order that a proper horizontal glide attitude will result.

BRIEF DESCRIPTION OF THE INVENTION

It is, therefore, the object of this invention to provide a model rocket which is capable of performing as a glider after the rocket has completed its vertical flight. Generally speaking, the invention comprises a solid fuel powered model rocket having a dual nose cone system. The first nose cone is utilized in vertical flight and is jettisoned by a second nose cone contained within the rocket body, which second nose cone is activated by a blow-out charge in the fuel cartridge, the second nose cone replacing the jettisoned first nose cone. The activation of the second nose cone also activates a wing elevator, directing the craft into a generally horizontal glide attitude.

DESCRIPTION OF THE DRAWINGS

The following drawings are illustrative of the invention.

DETAILED DESCRIPTION OF THE INVENTION

Figure 1:
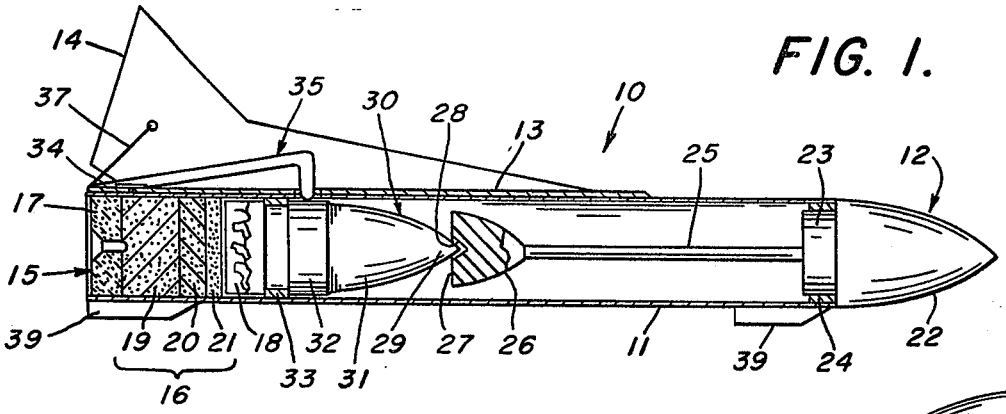
FIG. 1 is a side sectional view of a model rocket-glider according to the invention.
Figure 2:
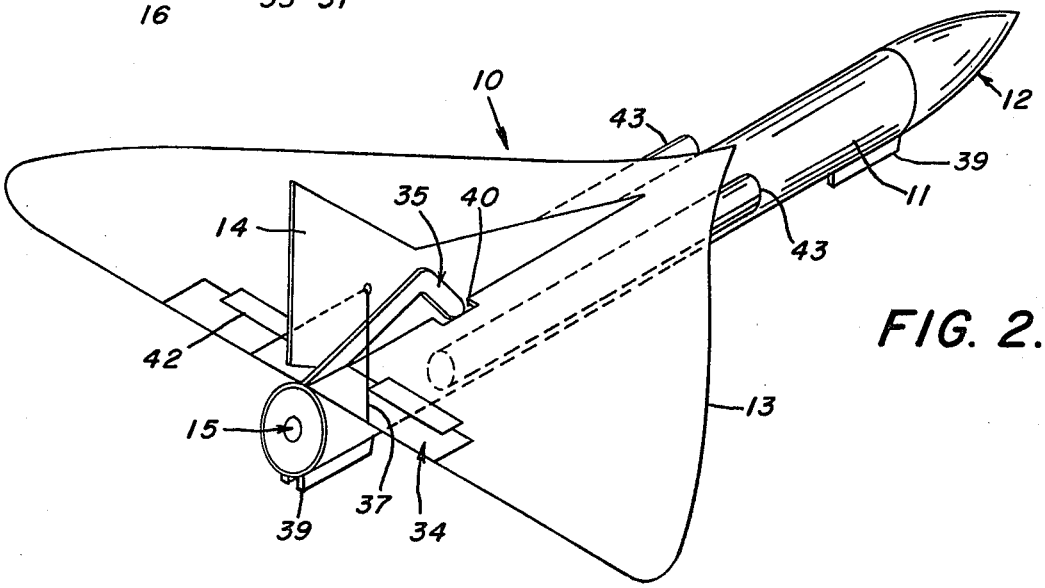
FIG. 2 is a rear perspective view of the model rocket-glider of the invention.

In FIGS. 1 and 2, 10 generally indicates a model rocket-glider having a generally tubular body portion 11, a nose cone 12, wings 13 and a stabilizing fin 14. The rocket is further provided with a commercially available solid fuel motor 15. The motor 15, usually comprises a propellant charge 16 compressed against a ring 17 of refractory material. The forward end of the motor is closed by a cap 18. The propellant charge 16 is made of an explosive composition, such as black powder or the like, compounded with other materials as is well known in the art so as to burn at the desired rate. The propellant charge is generally formed in three sections, i.e., a first charge 19 of compressed black powder having a high burning rate; a second charge 20 of slower burning power; and a third or blow-out charge 21. As is well known, the first charge 19 provides the initial or lift-off thrust to the rocket; the second charge 20 boosts the rocket to maximum altitude and the third or blow-out charge 21 provides sufficient energy to eject the nose cone 12 from the body 11.

Of course, the dimensions of the rocket body 11, the dimensions of the wings 13 and stabilizing fin 14, as well as the dimensions and propellant characteristics of the motor 15, are selected in a manner well known to the art, such that the rocket will have the desired vertical flight characteristics and horizontal glide attitude.

The rocket nose cone 12 consists of an upper or outer portion 22 and a lower or plug portion 23. The upper or outer portion 22 of the rocket nose cone 12 is of any suitable streamlined configuration, such as the conical shape shown having a cross-sectional diameter at least as great as the outside diameter of the tubular body 11. The plug portion 23 is generally cylindrical and coaxial with the upper portion 22. The length and diameter of the plug portion 23 are sufficient to permit the same to be frictionally engaged by the retainer ring 24 secured in the topmost end of the body tube 11. The fit should be snug, but not so snug as to prohibit easy ejection of the nose cone 12 from the body portion 11.

Although the nose cone 12 is described as having two portions, 22 and 23, it is generally constructed as a unitary assembly which can readily be molded or cast from suitable material such as plastic or carved from wood.

As shown in FIG. 1, secured to the bottom of the nose cone 12 and coaxial therewith is a rod or shaft 25, the lower end of which rod is secured to and coaxial with a conical seat block 26, the diameter of which is less than the inside diameter of the retainer ring 24. The rear end 27 of the seat block 26 contains a depression 28, which depression is configured to engage the tip 29 of the glider nose cone 30. The glider nose cone 30 consists of an upper portion 31 and a lower or sleeve portion 32. The upper portion 31 of glider nose cone 30 is of any suitable streamlined configuration, such as the conical shape illustrated, the diameter at its widest point being such as to be frictionally engaged by the retainer ring 24. The lower or sleeve portion 32 is generally cylindrical and coaxial with the upper portion 31 and has a diameter slightly less than the inside diameter of the body tube 11, but greater than the inside diameter of the retainer ring 24 such that the nose cone 30 may move freely when disposed in the body tube. Movement of the nose cone 30 in the direction of the motor 15 is restrained by another retainer ring 33 which is similar to retainer ring 24.

As shown in FIG. 2, an elevator 34 is provided in the trailing edge of the wings 13. The elevator 34 is provided with hinges 42 whereby the elevator may be angularly disposed with respect to the horizontal plane of the wings. The hinges may be made of resilient material such as cloth or the like. Resilient means 37 are employed to bias the elevator at a predetermined upward angle relative to the top horizontal plane of the wings. In the embodiment shown, an elastic band or the like is passed through an aperture 41 in the vertical stabilizing fin 14 and each end of the rubber band is secured to the elevator. It is, of course, to be realized that other suitable biasing means, such as small springs or the like, may also be used.

Figure 3:
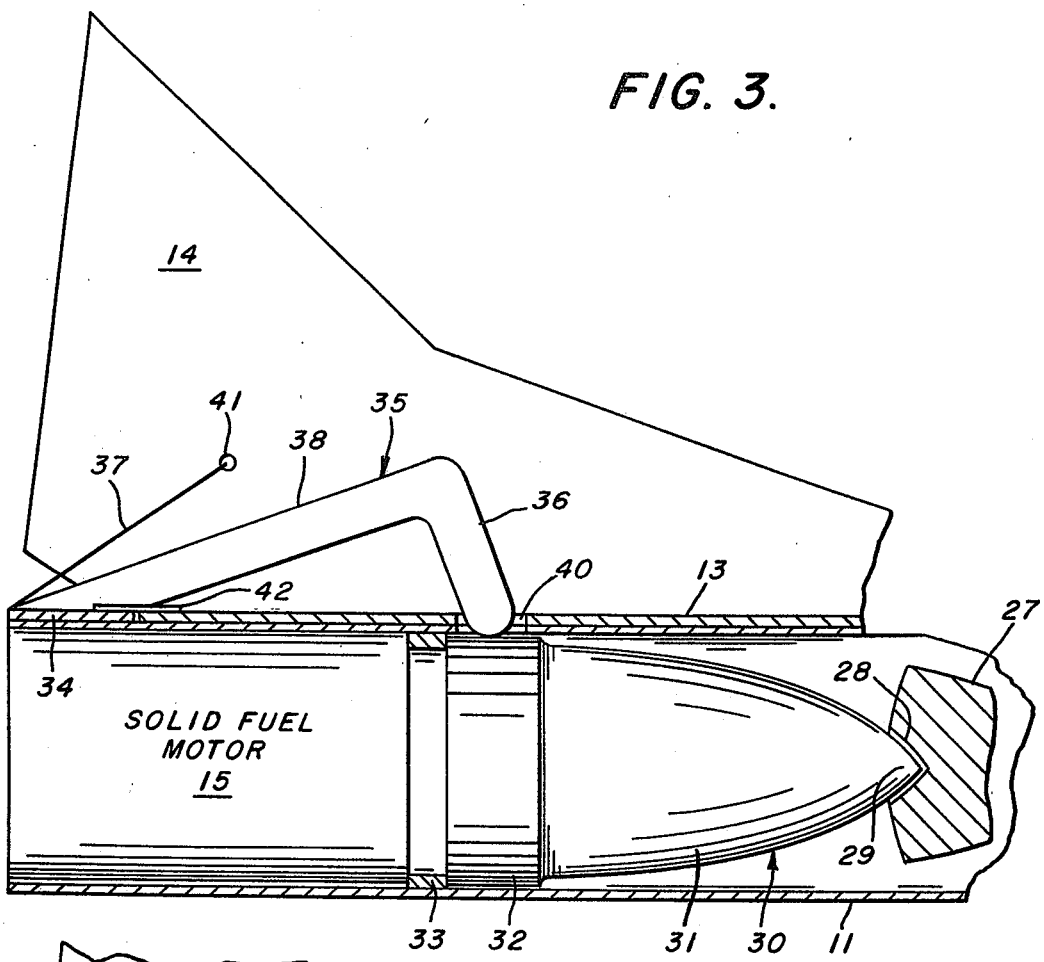
FIG. 3 is an enlarged side sectional view of the wing elevator actuating assembly, with the wing elevator positioned for vertical take-off.

For vertical flight, the elevator 34 must be maintained parallel to the horizontal plane of the wings 13 and means are provided for maintaining this configuration, which, as shown in FIG. 3, comprises a generally L-shaped member 35. The short arm 36 of member 35 protrudes through a slot 40 formed in body tube 11 and bears on the sleeve portion 32 of glider nose cone 30. The long arm 38 of member 35 is secured to the elevator 34 and is so sized that when the short arm 36 bears on sleeve portion 32 of glider nose cone 30, the elevator 34 is biased against the upward pull of the resilient means 37 and is maintained parallel to the horizontal plane of the wings 13.

Figure 4:
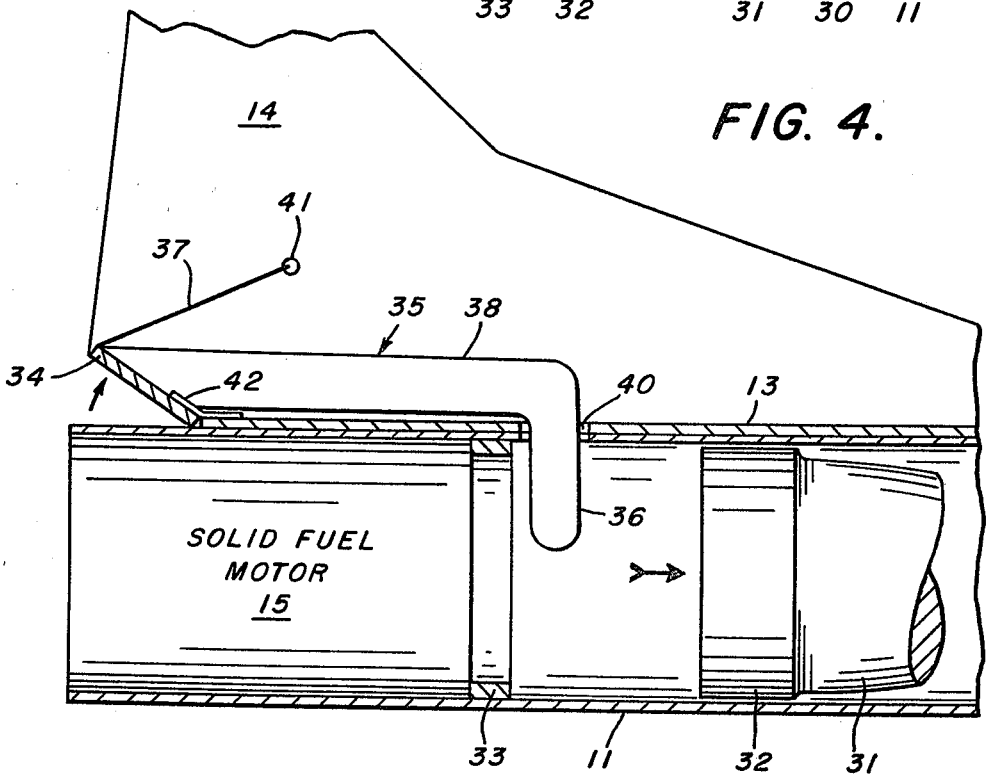
FIG. 4 is an enlarged side sectional view of the elevator actuating assembly, with the wing elevator positioned for horizontal glide.

After maximum vertical flight has been attained and the propellant charge has been exhausted, the elevator 34 must be deployed at its predetermined up angle relative to the top horizontal plane of the wings 13 in order for the rocket-glider to attain a proper horizontal glide attitude. This means of deployment is illustrated in FIG. 4. As before described, when propellant charges 19 and 20 are exhausted, the blow-out charge 21 is ignited. Ignition of charge 21 propels the glider nose cone 30 toward the forward end of the body tube 11 in the direction shown by the arrow. The glider nose cone 30 in turn ejects the rocket nose cone 12 and associated rod 25 and seat block 26 from the body tube 11. The glider nose cone 30 is restained from further forward movement by engagement with retaining ring 24. Due to the forward movement of nose cone 30, the short arm 36 of member 35 no longer bears on sleeve portion 32, tension in resilient means 37 is relaxed, and the elevator 34 is biased in the predetermined up angle position relative to the horizontal plane of the wings 13, the short arm 36 extending into the interior of the body tube 11 and the long arm 38 lying substantially parallel to the body tube 11.

The angle at which the elevator is biased is, of course, a function of the size, weight, wing loading and overall dimensions of the rocket-glider. The precise angle is determined empirically, in a manner well known to the art, by test gliding the completed assembly and adjusting the elevator accordingly when the desired glide pattern is attained. To achieve proper balance it might be necessary to add ballast at various points in the form of small weights, such as lead shot, lumps of clay or the like. Notwithstanding the size and weight of the assembly, the elevator angle should not exceed about 22°, as too great an angle will result in stalling. After the proper angle has been determined the resilient means 37 is adjusted so as to bias the elevator at said angle and the L-shaped member 35 is sized accordingly.

Figure 5:
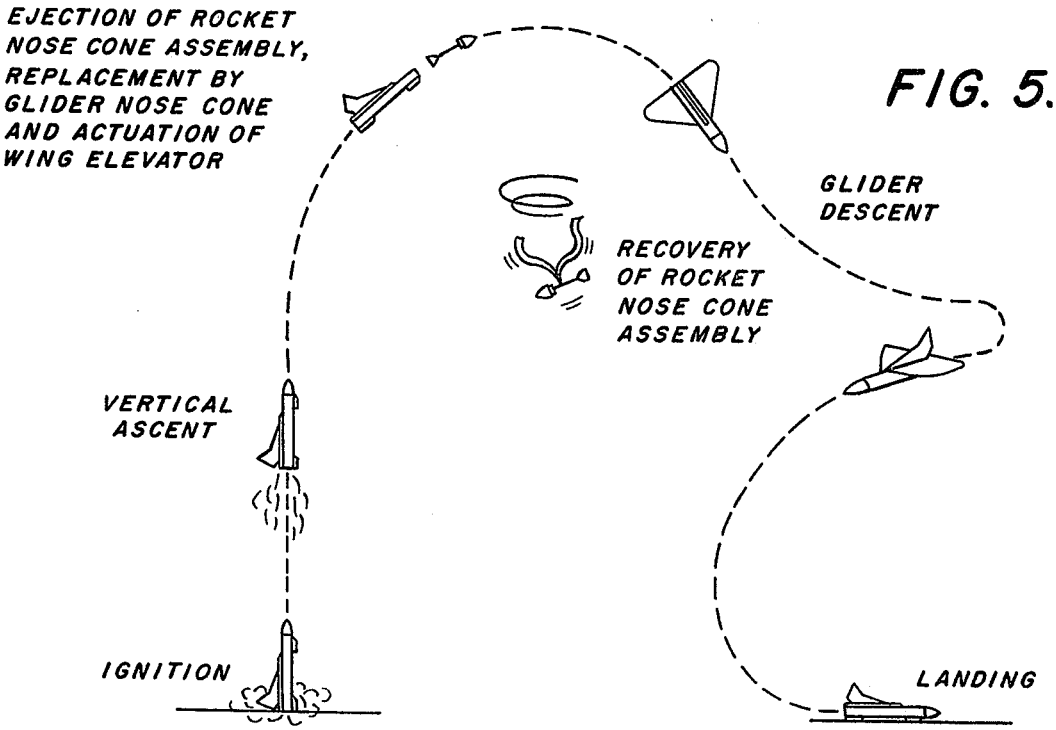
FIG. 5 is illustrative of the mode of operation of the model rocket-glider of the invention.

FIG. 5 is illustrative of the mode of operation of the rocket-glider of the invention. The motor is ignited by suitable means, such as an electric igniter (not shown) and the rocket-glider flies upwardly along a substantially vertical path. Following burn-out of the propellant charge, the blow-out charge ignites with sufficient energy to propel the glider nose cone forwardly and eject the rocket nose cone assembly free of the body. The glider nose cone becomes frictionally engaged in substantially the position previously occupied by the rocket nose cone, the elevator is actuated and the assembly glides back to earth. The ejected rocket nose is provided with a suitable recovery means, such as the streamer shown, which assures a soft landing.

As shown in FIG. 1, landing skids 39 may be provided to prevent damage to the body tube and to protect against scratches to the painted finish upon landing. As shown in FIG. 2, hollow stabilizing tubes 43 may also be provided which tubes are both decorative as well as useful in balancing the assembly during flight. A stabilizing tube 43 is located beneath each wing 13, the longitudinal axis of each tube 43 being parallel to the longitudinal axis of body portion 11, each tube 43 being secured to the underside of each wing 13 and to body portion 11.

Although a streamer is illustrated as a recovery means for the rocket nose cone assembly, which streamer is wrapped around the shaft 25, a parachute may also be employed. If a more spectacular display is desired, the rocket nose cone assembly may be provided with a deployable rotor device as described in the aforementioned copending U.S. application Ser. No. 378,595, the teachings of which application are herein incorporated by reference as regards the construction and employment of said rotor assembly.

The rocket glider described herein may be fabricated from any suitable materials known to the scale modeling art, such as light-weight woods, plastics and the like. It is to be further understood that the drawings and description herein serve to illustrate the preferred embodiments of the invention and that many variations may be apparent to, and made therein, by those skilled in the art without departing from the spirit and scope of the invention.

What is claimed is:

1. A model rocket comprising a body tube, a solid fuel motor having a propellant charge and a blow-out charge mounted in the lower end of the body tube, a first nose cone frictionally engaged in the upper end of the body tube, a second nose cone slidably disposed within the body tube and wings affixed to the body tube, said wings having a hinged elevator formed in the trailing edge thereof, said second nose cone being propelable toward the upper end of the body tube by the ignition of the blow-out charge in said motor after the propellant charge has exhausted, whereby said second nose cone ejects the first nose cone while the rocket is in flight and becomes engaged in the position occupied by the first nose cone, further including means for maintaining said elevator parallel to the horizontal plane of the wings prior to ignition of said blow-out charge and resilient means for biasing said elevator at a predetermined up-angle relative to the top horizontal plane of the wings subsequent to the ignition of said blow-out charge thereby causing the rocket to assume a glider configuration.

2. The model rocket of claim 1 wherein said means for maintaining the elevator parallel to the horizontal plane of the wings comprises an L-shaped member, the shorter arm of which member protrudes through a slot formed in the body tube and is in abutting relationship with the second nose cone disposed within the body tube and the end of the longer arm of which member is secured to the elevator.

3. The model rocket of claim 1 wherein the predetermined up-angle at which the elevator is biased does not exceed about 22°.

4. The model rocket of claim 1 further including means for recovering the first nose cone after it has been ejected.

5. A model rocket comprising a body tube, a solid fuel motor having a propellant charge and a blow-out charge mounted in the lower end of the body tube, a first nose cone frictionally engaged in the upper end of the body tube, wings and a vertical stabilizer affixed to the body tube including means for converting the rocket to a glider while in flight, said means comprising:

a. a rod, the top end of which is secured to and coaxial with the underside of the first nose cone and the bottom end of which is secured to and coaxial with the upper end of a seat block;

b. a second nose cone slidably disposed within the body tube, the tip of the nose cone in abutting relationship with the bottom end of the seat block;

c. a hinged elevator in the trailing edge of the wings including resilient means for biasing said elevator at a predetermined up-angle relative to the top horizontal plane of the wings; and d. elevator restraining means secured to the elevator and cooperative with the second nose cone whereby the elevator is maintained parallel to the horizontal plane of the wings when the rocket is in vertical flight;

whereby when the propellant charge in said motor is exhausted and the rocket has attained its maximum altitude, a blow-out charge in said motor ignites, propelling the second nose cone toward the forward end of the body tube which second nose cone ejects the first nose cone and associated rod and seat block from the body tube while simultaneously disassociating from the elevator restraining means, the elevator becoming biased at said predetermined angle, the second nose cone becoming engaged in the position occupied by the ejected first nose cone causing the rocket to assume a glider configuration.

6. The model rocket of claim 5 wherein the resilient means for biasing the elevator at a predetermined up-angle relative to the top horizontal plane of the wings comprises an elastic band which is passed through an aperture formed in the vertical stabilizer, the ends of said elastic band being secured to the elevator.

7. The model rocket of claim 5 wherein the predetermined up-angle at which the elevator is biased does not exceed about 22°.

8. The model rocket of claim 5 wherein the elevator restraining means comprises an L-shaped member, the shorter arm of which member protrudes through a slot formed in the body tube and is in abutting relationship with the second nose cone disposed within the body tube and the end of the longer arm of which member is secured to the elevator.

9. The model rocket of claim 5 wherein the bottom end of the seat block has a depression formed therein which depression is configured to engage therein the tip of the second nose cone.

10. The model rocket of claim 5 further including means for recovering the ejected first nose cone and associated rod and seat block.

* * * * *